US005097902A

United States Patent [19]

Clark

[11] Patent Number: 5,097,902

[45] Date of Patent: Mar. 24, 1992

[54] PROGRESSIVE CAVITY PUMP FOR DOWNHOLE INFLATABLE PACKER

[75] Inventor: John A. Clark, South Lake, Tex.

[73] Assignee: Halliburton Company, Duncan, Okla.

[21] Appl. No.: 602,453

[22] Filed: Oct. 23, 1990

[51] Int. Cl.[5] ..... E21B 33/127

[52] U.S. Cl. ..... 166/187; 166/68; 166/106; 418/48

[58] Field of Search ..... 166/187, 106, 68, 336; 418/48, 153

[56] References Cited

U.S. PATENT DOCUMENTS

| | | | |
|---|---|---|---|
| 2,690,224 | 9/1954 | Roberts | 166/120 |
| 3,083,774 | 4/1963 | Peters et al. | 166/187 |
| 3,291,219 | 12/1966 | Nutter | 166/145 |
| 3,439,740 | 4/1969 | Conover | 166/250 |
| 3,876,000 | 4/1975 | Nutter | 166/106 |
| 3,876,003 | 4/1975 | Kisling, III | 166/250 |
| 3,926,254 | 12/1975 | Evans et al. | 166/106 |
| 4,187,061 | 2/1980 | Jurgens | 418/48 |
| 4,246,964 | 1/1981 | Brandell | 166/106 |
| 4,313,495 | 2/1982 | Brandell | 166/53 |
| 4,320,800 | 3/1982 | Upchurch | 166/106 |
| 4,366,862 | 1/1983 | Brandell | 166/106 |
| 4,372,387 | 2/1983 | Brandell | 166/334 |
| 4,386,655 | 6/1983 | Brandell | 166/106 |
| 4,388,968 | 6/1983 | Brandell | 166/236 |
| 4,412,584 | 11/1983 | Brandell | 166/169 |
| 4,457,367 | 7/1984 | Brandell | 166/105 |
| 4,458,752 | 7/1984 | Brandell | 166/187 |
| 4,706,746 | 11/1987 | White et al. | 166/106 |
| 4,729,430 | 3/1988 | White et al. | 166/106 |
| 4,756,364 | 7/1988 | Christensen et al. | 166/187 |
| 4,818,197 | 4/1989 | Mueller | 418/48 |
| 4,877,086 | 10/1989 | Zunkel | 166/106 |

OTHER PUBLICATIONS

Oilweek, Sep. 1, 1980, p. 11.

Lynes Product No. 302-40, shown on pp. 2964-2966 of their catalog.

Johnston/Schlumberger Form J-432.

Brochure entitled "Moyno Downhole Oil Well Pumps" published by Robbins & Myers, Inc., Moyno Oilfield Products (undated).

Paper No. SPE 9607 entitled "Use of a Down-Hole Mud Motor as a Pump for Drill-Stem Testing", published by Society of Petroleum Engineers, 1981.

Paper entitled "Norton Christensen Information Navi--Pump", dated Mar. 2, 1984.

*Primary Examiner*—Terry L. Melius

*Attorney, Agent, or Firm*—C. Dean Dominque; Neal R. Kennedy

[57] ABSTRACT

A progressive cavity pump for inflating downhole inflatable packers. The pump includes a case defining an inlet port and an outlet passageway therein in which the outlet passageway is in communication with the inflatable packer at a location below the pump in the well bore. An elastomeric stator is disposed in the case between the inlet port and the outlet passageway, and the stator has a convoluted inner surface. A rotor is disposed in the stator and rotatable with respect thereto. The rotor defines a convoluted outer surface thereon engaged with the inner surface of the stator such that a plurality of progressive pumping cavities are defined therebetween. As the rotor is rotated within the stator, fluid is moved from one cavity to the next, thereby pumping fluid from the inlet to the outlet. The rotor has a central opening therethrough which provides communication between the packer and an upper testing string portion. The rotor is supported on bearings and/or bushings. An oil reservoir provides lubrication to the bearings. A debris collection chamber collects debris in the pump. The rotor and stator are sized such that the differential pressure across the pump is limited to a predetermined level so that the packers cannot be overinflated.

14 Claims, 4 Drawing Sheets

PROGRESSIVE CAVITY PUMP FOR DOWNHOLE INFLATABLE PACKER

BACKGROUND OF THE INVENTION

1. Field Of The Invention

This invention relates to downhole testing apparatus having pumps used for inflating inflatable packers, and more particularly, to a testing apparatus with a progressive cavity inflatable packer pump.

2. Description Of The Prior Art

A known method of testing a well formation is to isolate the formation between a pair of inflatable packers with a flow port therebetween adjacent to the formation. The packers are inflated by means of a pump in the testing string which pumps well annulus fluid or mud into the packers to place them in sealing engagement with the well bore. A variety of such pumps are available.

One type of downhole pump is actuated by the vertical reciprocation of the tubing string connected to the pump. Such a pump is disclosed in Nutter U.S. Pat. No. 3,876,000 and Kisling, III U.S. Pat. No. 3,876,003. This method of reciprocation results in many operational problems, and so other pumps have been developed which are operated by rotation of the tubing string relative to the pump structure connected thereto.

One type of rotationally operated pump uses a plurality of vertically disposed pistons which are driven by a cam structure. Inlet and outlet valves are positioned adjacent to each of the pistons. Typical multiple piston pumps are disclosed in Conover U.S. Pat. No. 3,439,740 and Brandell U.S. Pat. No. 4,246,964, both of which are assigned to the assignee of the present invention. These types of pumps require precise machining and assembly which are relatively expensive and susceptible to damage by impurities in the well fluid. In particular, the valves for each pump can be relatively easily clogged.

A simpler, sleeve-type pump piston is used in the downhole pump of Evans, et al., U.S. Pat. No. 3,926,254, assigned to the assignee of the present invention. This pump uses a plurality of sealing rings of V-shaped cross section for intake and exhaust check valves. In the Evans et al. apparatus, as well as the other pumps described above, the pump piston is in direct contact with well annulus fluid which, because of impurities therein, can result in reduced service life.

In White et al. U.S. Pat. No. 4,706,746, assigned to the assignee of the present invention, a pump is disclosed which uses the more simple sleeve-type pump piston and further includes a diaphragm which separates a piston chamber in which the piston reciprocates from a pumping chamber with inlet and outlet valves therein through which the well fluid is moved to inflate the packers. The piston chamber is filled with clean hydraulic lubricant which promotes longer life for the pump parts. Backup wiper rings are provided to clean the piston of abrasive particulate in the event that the diaphragm is ruptured. Inlet and outlet check valves with resilient annular lips are used, and these are not easily clogged or damaged by abrasives in the well fluid.

The White et al. pump utilizes a pressure limiter which vents around the outlet check valve to the packers at the lower end of the testing string rather than venting to the well annulus.

The same pump is disclosed in White et al. U.S. Pat. No. 4,729,430, also assigned to the assignee of the present invention, which further discloses additional pressure limiter embodiments. Two of these embodiments utilize a pressure limiter piston which reciprocates at a predetermined pressure to increase the volume of the pumping chamber. Another embodiment does not use a specific pressure limiting mechanism, but instead uses a pumping chamber of predetermined volume such that the efficiency of the pump drops to essentially zero when the pressure in the pumping chamber reaches a predetermined level. This necessitates a fairly long tool, and the pressure limiting is a result of this increased volume rather than slippage in the pump itself.

Most of the other pumps of the prior art include relief valves which relieve pressure from the pump to the well annulus. All of these relief devices are relatively complex and add cost to the tool.

In most cases, the prior art pumps have worked well, but are susceptible to clogging and jamming when pumping some fluids such as shales, sand and viscous muds. The pump of the present invention which utilizes a progressive cavity design will handle virtually any fluid that is not corrosive to its components. Progressive cavity pumps are generally known for small pump applications, such as disclosed in Mueller U.S. Pat. No. 4,818,197, assigned to the assignee of the present invention. Progressive cavity pumps have also been adapted for use in downhole tools as production and drill stem testing pumps, such as the Moyno pumps of Robbins & Myers, Inc., and the Norton Christensen NaviPump. These pumps are not used for inflating packers.

Further, the pump of the present invention does not require the expensive and complex necessity of an additional pressure limiting device because the rotor and stator in the progressive cavity pump can be sized such that the pump will not pump fluid once it reaches a specific differential pressure due to internal fluid slippage. That is, the progressive cavity pump itself provides a built-in pressure limitation means. This also allows a more compact tool string and simpler operation.

SUMMARY OF THE INVENTION

The progressive cavity pump of the present invention is designed for use in inflating downhole inflatable packers. The invention also relates to downhole testing apparatus using such pumps.

The pump comprises case means for attaching to a lower testing string portion and having an inlet and an outlet, mandrel means for connecting to an upper testing string portion for mutual rotation therewith and rotating within the case means, an elastomeric pump stator disposed in the case means and a rotor extending from the mandrel means and into the stator. The stator has a convoluted inner surface, and the rotor has a convoluted outer surface so that the stator and rotor define a plurality of cavities therebetween. Rotation of the rotor within the stator moves fluid progressively from cavity to cavity and thereby from the inlet to the outlet in the case means. The stator sealingly engages an inner surface of the case means in the preferred embodiment.

The pump also comprises passageway means for providing fluid communication between the lower testing string portion and the upper testing string portion. The passageway means is sealingly separated from the cavities defined between the stator and rotor. At least a portion of this passageway means is characterized by a central opening defined through the pump rotor.

The pump preferably further comprises mandrel bearing means for rotatably supporting the mandrel means in the case means. Rotor bearing means may also be provided for supporting an end of the rotor opposite the mandrel means. In one embodiment, the mandrel bearing means may be considered a portion of the rotor bearing means.

The pump further comprises oil reservoir means for providing lubrication to the bearing means and pressure equalizing means for equalizing a hydrostatic pressure of a fluid, such as oil, in the oil reservoir means with fluid pressure in a well annulus adjacent to the case means.

Also in the preferred embodiment, the pump comprises means for substantially limiting a differential pressure across the pump to a predetermined value. In the embodiment, shown, the rotor and stator are sized such that fluid slippage through the pump itself provides this pressure limitation means without an additional or separate pressure limiting device or means. Thus, a predetermined maximum discharge pressure is supplied to the packers and over-inflation is prevented.

A further preferred embodiment of the pump comprises debris collection means for collecting within the pump at least a portion of debris present in fluid discharged from the pump such that the collected debris is prevented from being further discharged to the inflatable packers. In the preferred embodiment, this collection means is characterized by an annular volume in the pump located below the pump rotor and pump stator.

The present invention may also be said to include a downhole tool for use on a testing string in a well annulus. The tool comprises a tester valve, a progressive cavity pump having a pump inlet in communication with a well annulus and a pump outlet, a packer positionable in the well annulus above a formation to be tested, and a porting sub positionable adjacent to the formation for allowing well fluid flow therethrough. The packer is in communication with the pump outlet and is inflatable by the pump into sealing engagement with the well annulus and deflatable by upward movement of the testing string. The pump defines a central flow passageway means therethrough for allowing fluid to flow from the porting sub to a portion of the tool string above the pump.

It is an important object of the present invention to provide a progressive cavity pump for inflating inflatable packers in a testing string.

Another important object of the invention is to provide a well testing string with a pump that does not require a separate pressure limiting device.

It is a further object of the present invention to provide a testing string suitable for use with fluids containing abrasives.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1A:
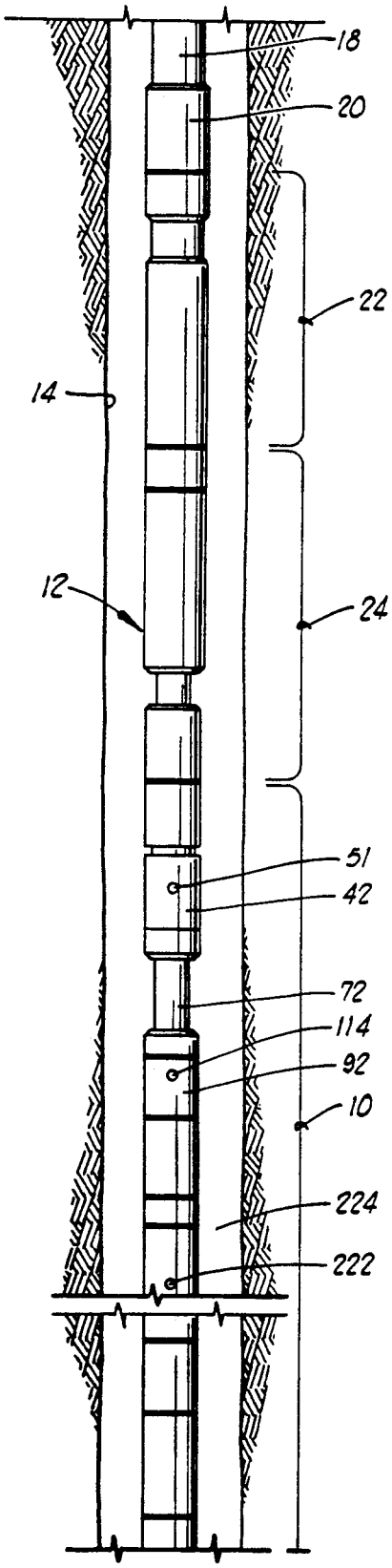
FIGS. 1A-1B show the progressive cavity inflatable packer pump and testing apparatus of the present invention in position in a well bore for testing a well formation.
Figure 1B:
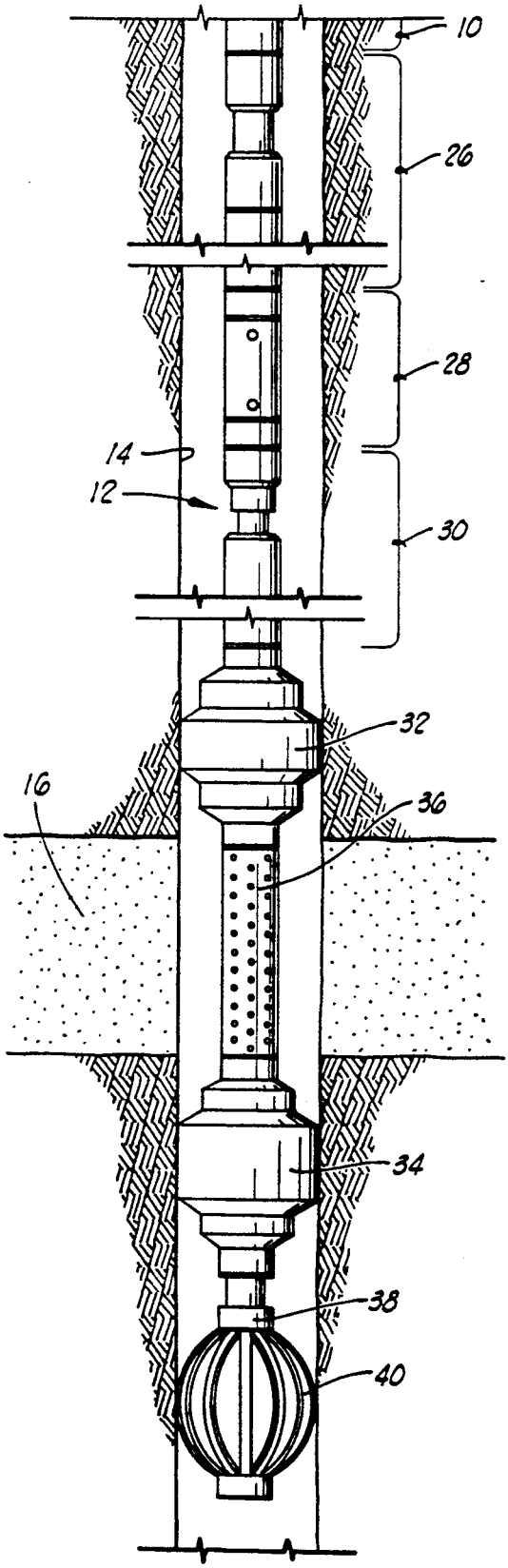

Referring now to the drawings, and more particularly, to claims 1A-1B, the progressive cavity pump of the present invention is shown and generally designated by the numeral 10. Pump 10 forms a part of a testing string apparatus or tool 12 which is shown in position in a well bore 14 for use in testing a well formation 16.

Testing apparatus 12 is attached to the lower end of a tool string 18 and includes a reversing sub 20, a testing valve 22 such as the Halliburton Hydrospring ® tester, and an extension joint 24, all of which are positioned above pump 10.

Disposed below pump 10 in testing apparatus 12 are a packer bypass 26, a string bypass 28, and a safety joint 30 such as the Halliburton Hydroflate ® safety joint.

An upper packer 32 is attached to the lower end of safety joint 30 and is disposed above formation 16. A lower packer 34 is positioned below well formation 16. A porting sub 36 interconnects inner packer 32 and lower packer 34. An equalizing tube and spacers (not shown) may also be used between upper packer 32 and lower packer 34 if additional longitudinal separation is required therebetween depending on the size of well formation 16.

Upper packer 32 and lower packer 34 are inflatable by pump 10 in a manner hereinafter described such that the packers may be placed in sealing engagement with well bore 14, thus isolating well formation 16 so that a testing operation may be carried out.

A gauge carrier 38 is attached to the lower end of lower packer 34 and includes a plurality of drag springs 40 which are adapted to engage well bore 14 and prevent rotation of a portion of testing apparatus 12 during inflation of upper packer 32 and lower packer 34, as hereinafter described.

Figure 2A:
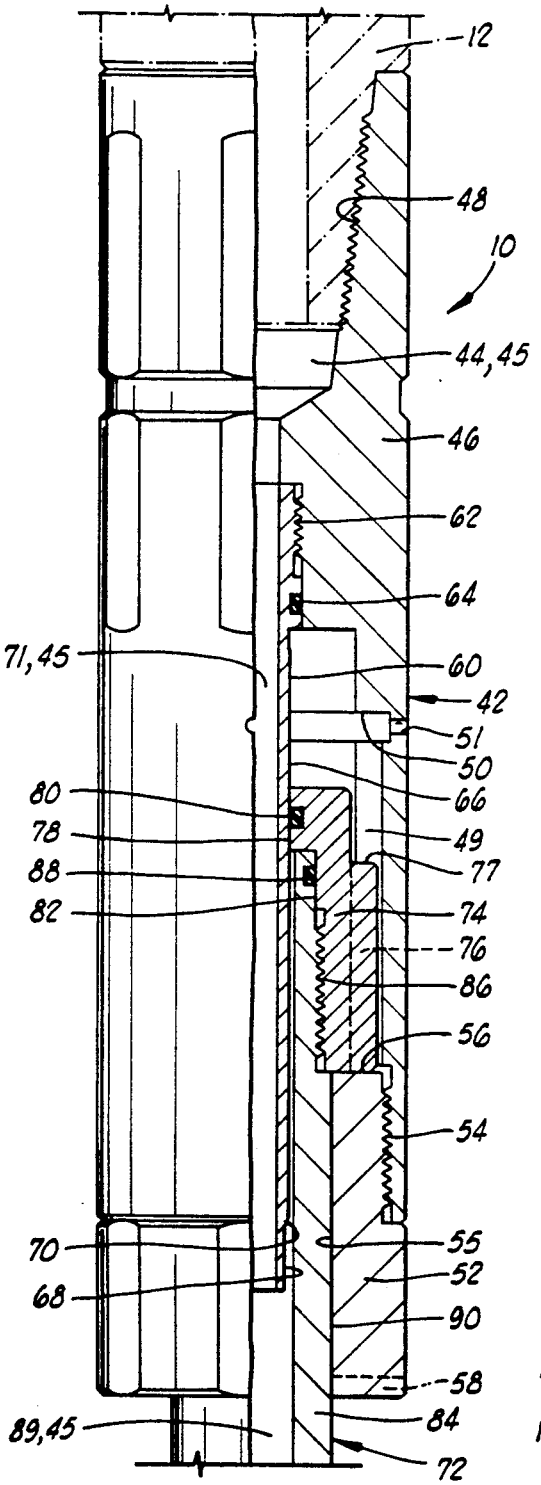
FIGS. 2A-2F show a partial longitudinal cross-section of the progressive cavity pump.

Referring now to FIGS. 2A-2F. the details of pump 10 are shown. As seen in FIG. 2A, pump 10 includes upper adapter means 42 defining a longitudinally central opening 44 therethrough. The upper end of central opening 44 is part of a flow passageway means 45 for providing communication through pump 10 between portions of testing apparatus 12 above and below the pump. In the illustrated embodiment, passageway means 45 is characterized by a generally central opening through pump 10.

Upper adapter means 42 includes a top adapter 46 with an internally threaded upper end 48 adapted for attachment to an upper portion of testing apparatus 12 above pump 10. Top adapter 46 defines an internal spline 49 therein with a downwardly facing shoulder 50 at the upper end thereof. A tranverse hole 51 is defined through top adapter 46 adjacent to shoulder 50.

Forming a lower part of upper adapter means 42 is a torque case 52 which is attached to a lower end of top adapter 46 at threaded connection 54. Torque case 52 has a bore 55 therein, and upper end 56 of the torque case forms a shoulder at the lower end of spline 49 in top adapter 46. Torque case 52 also has at least one downwardly directed lug 58 at the lower end thereof.

An additional portion of upper adapter means 42 is a spline guide tube 60 which is connected to top adapter 46 at threaded connection 62. A sealing means, such as O-ring 64, provides sealing engagement between guide tube 60 and top adapter 46. Guide tube 60 has a first outside diameter 66 and a smaller second outside diameter 68 at the lower end thereof. A downwardly facing chamfer 70 interconnects first outside diameter 66 and second outside diameter 68. A central opening 71 is defined through spline guide tube 60 and forms part of passageway means 45.

An upper mandrel means 72 extends into central opening 44 of upper adapter means 42. Upper mandrel means 72 includes a torque body 74 with an externally splined portion 76 engaged with internal spline 49 in top adapter 46. An upper end 77 of spline 76 faces shoulder 50 in top adapter 46.

Torque body 74 has a first bore 78 which is in close, sliding relationship with first outside diameter 66 of guide tube 60. A sealing means, such as O-ring 80, provides sliding, sealing engagement between guide tube 60 and torque body 74. Torque body 74 also has a larger second bore 82.

It will be seen that relative longitudinal movement between upper adapter means 42 and upper mandrel means 72 is possible while relative rotation therebetween is prevented by the mutual engagement of splines 49 and 76.

The upper end of a floating piston mandrel 84 is threadingly engaged with torque body 74 at threaded connection 86. Sealing is provided between floating piston mandrel 84 and second bore 82 of torque body 74 by a sealing means, such as O-ring 88. Floating piston mandrel 84 defines a central opening 89 therethrough and has an outer surface 90 which is close, sliding relationship with bore 55 at the lower end of torque case 52. It will be seen that central opening 89 is part of passageway means 45.

It also will be seen that, while upper adapter means 42 and mandrel means 72 are relatively slidable, they are inseparable without breaking at least one threaded connection. Therefore, it may be said that upper adapter means 42 may form a portion of mandrel means 72.

Figure 2B:
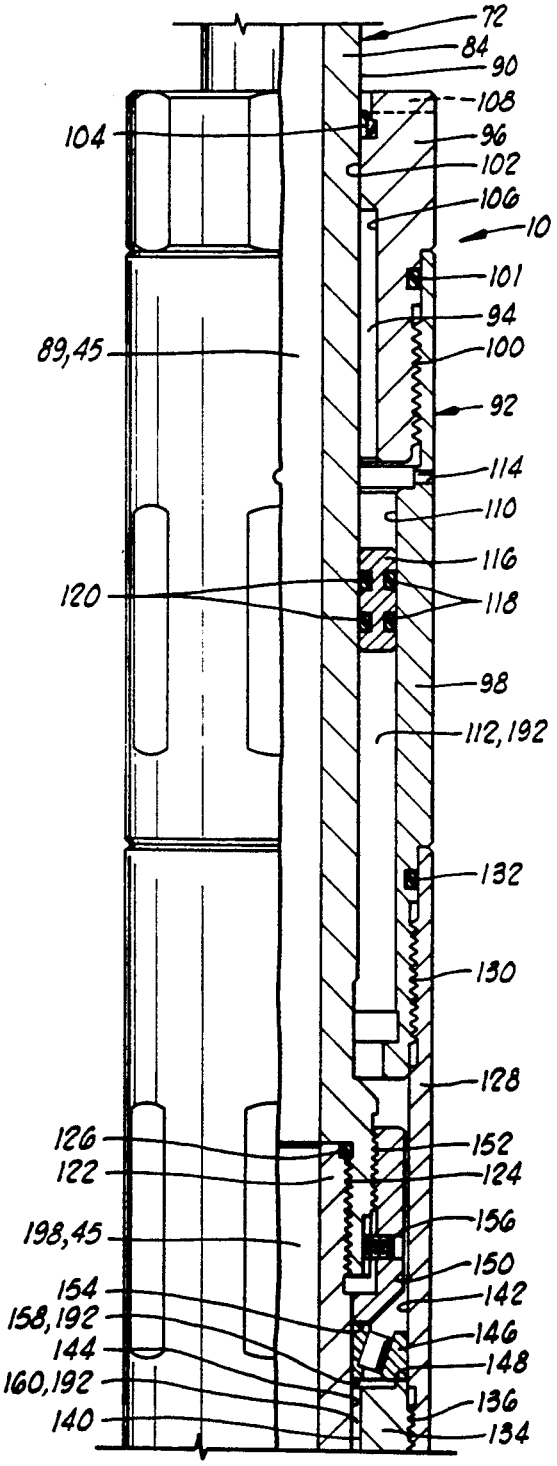

Referring now to FIG. 2B, pump 10 also includes an outer case means 92, spaced below upper adapter means 42, which defines a central opening 94 therethrough. The lower end of upper mandrel means 72 extends into central opening 94, and thus the upper mandrel means interconnects upper adapter means 42 and outer case means 92.

At the upper end of case means 92 is a piston cap 96 attached to a floating piston case 98 at threaded connection 100. A sealing means, such as O-ring 101, seals between piston cap 96 and floating piston case 98.

Piston cap 96 has a first bore 102 in close, spaced relationship with outer surface 90 of floating piston mandrel 84. A sealing means, such as seal 104, provides sealing engagement between piston cap 96 and mandrel 84. Piston cap 96 has a second bore 106 which is spaced outwardly from outer surface 90 of mandrel 84.

At least one lug 108 extends from the upper end of piston cap 96. Lugs 108 are dimensioned to be engageable with lugs 58 on torque case 52 when desired, as will be discussed in more detail herein.

Floating piston case 98 has an inner bore 110 which is outwardly spaced from outer surface 90 of floating piston mandrel 84 such that an annular equalizing chamber 112 is defined therebetween. At the upper end of bore 110 is a transverse hole or opening 114 which will be seen to be in communication with an upper end of equalizing chamber 112.

Reciprocably disposed in equalizing chamber 112 is an annular, floating equalizing piston 116. An outer sealing means, such as a plurality of piston rings 118, provides sealing between equalizing piston 116 and bore 110 of floating piston case 98. Similarly, an inner sealing means, such as a plurality of piston rings 120, provides sealing between equalizing piston 116 and outer surface 90 of floating piston mandrel 84. As will be more fully described herein, equalizing piston 116 is free to reciprocate in equalizing chamber 112 below hole 114 as determined by the differential pressure across the piston.

Figure 2C:
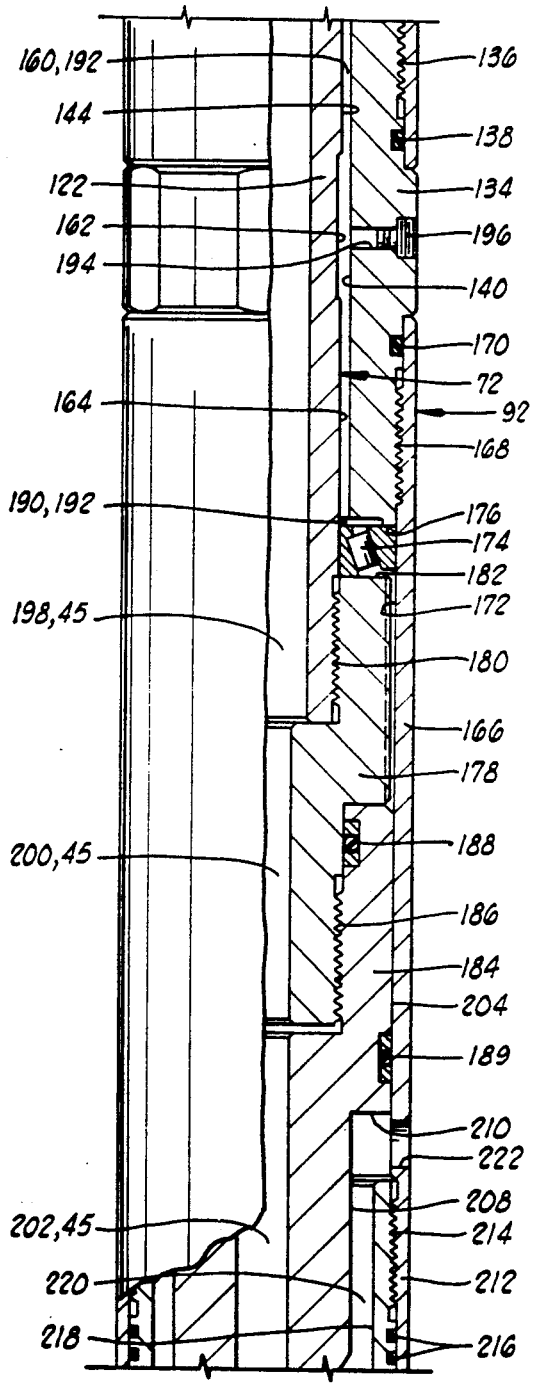

The lower end of floating piston mandrel 84 is attached to a bearing mandrel 122 at threaded connection 124. Sealing engagement is provided between floating piston mandrel 84 and bearing mandrel 122 by a sealing means, such as O-ring 126. The lower end of floating piston case 98 is attached to an upper bearing housing 128 at threaded connection 130. A sealing means, such as O-ring 132, provides sealing engagement therebetween. Referring now also to FIG. 2C, the lower end of upper bearing housing 128 is connected to an oil case 34 at threaded connection 136. A sealing means, such as O-ring 138, provides sealing engagement therebetween. Oil case 134 defines a bore 140 therethrough.

Referring again to FIG. 2B, upper bearing housing 128 defines a bore 142 therethrough which is spaced radially outwardly from first outside diameter 144 of bearing mandrel 122.

An upper bearing 146 is annularly disposed between first outside diameter 144 of bearing mandrel 122 and bore 142 of upper bearing housing 128. In the preferred embodiment, upper bearing 146 is a tapered roller bearing, but other bearings could also be used. The outer race of upper bearing 146 is positioned adjacent to annular upper end 148 of oil case 134. A bearing cap 150 is connected to floating piston mandrel 84 at threaded connection 152 such that an annular lower end 154 of the bearing cap engages the inner race of upper bearing 146. It will thus be seen that upper bearing 146 is clamped longitudinally in position. A fastening means, such as set screw 156, is used for locking bearing cap 150 in its position relative to floating piston mandrel 84.

At the upper end of oil case 134 is an annular recess 158 which is in communication with an annulus 160 defined between bore 140 in oil case 134 and first outside diameter 144 of bearing mandrel 122.

Referring again to FIG. 2C, bearing mandrel 122 has a smaller second outside diameter 162 and a third outside diameter 164 therebelow.

The lower end of oil case 134 is attached to a lower bearing housing 166 at threaded connection 168. A sealing means, such as O-ring 170, provides sealing engagement therebetween. Lower bearing housing 166 defines a bore 172 therethrough which is spaced radially outwardly from third outside diameter 164 of bearing mandrel 122.

A lower bearing 174, substantially identical to upper bearing 146, is annularly disposed between third outside diameter 164 of bearing mandrel 122 and bore 174 in lower bearing housing 166. The outer race of lower bearing 174 is positioned adjacent to annular lower end 176 of oil case 134. A bearing retainer 178 is attached to the lower end of bearing mandrel 122 at threaded connection 180. Upper end 182 of bearing retainer 178 is adapted for engaging the inner race of lower bearing 174 so that the lower bearing is clamped longitudinally against oil case 134.

It will be seen by those skilled in the art that upper bearing 146 and lower bearing 174 characterize a mandrel bearing means for rotatably supporting upper mandrel means 72 within outer case means 92.

The lower end of bearing retainer 178 is connected to the enlarged upper end of pump rotor 184 at threaded connection 186. A sealing means, such as seal 188, provides sealing engagement between bearing retainer 178 and pump rotor 184. Another sealing means, such as seal 189, provides sealing engagement between pump rotor 184 and lower bearing housing 166. As will be further described herein, the sealing engagement provided by seal 189 is a rotating sealing engagement.

An annular recess 190 is defined at the lower end of oil case 134, and it will be seen that recess 190 is in communication with annulus 160 and recess 158. A study of FIGS. 2B and 2C will show that annulus 160 is in communication with the portion of equalizing chamber 112 below equalizing piston 116. Equalizing chamber 112, recess 158, annulus 160 and recess 190 form a portion of an oil reservoir means 192 between upper mandrel means 72 and outer case means 92. The upper limit of oil reservoir means 192 is defined by equalizing piston 116, and the lower limit is defined by seals 188 and 189.

Oil case 134 has a transverse hole 194 therethrough which generally faces second outside diameter 162 of bearing mandrel 122 and is in communication with oil reservoir means 192. Oil reservoir means 192 may be characterized by an oil reservoir 192 filled with lubricating oil through transverse hole 194, thus providing lubricating oil to equalizing piston 116, upper bearing 146 and lower bearing 174. After filling oil reservoir 192 with oil, hole 194 is closed by a plug 196.

Bearing mandrel 122 defines a central opening 198 therethrough which is in communication with central opening 89 in floating piston mandrel 84. Central opening 198 is in communication with a central opening 200 in bearing retainer 78 which in turn is in communication with a central opening 202 in pump rotor 184. Central openings 198, 200 and 202 form parts of passageway means 45 through pump 10.

Pump rotor 184 has a first outside diameter 204 which is in close, rotating relationship with bore 172 in lower bearing housing 166. Below first outside diameter 204 of pump rotor 184 is a smaller second outside diameter 208. A downwardly facing annular shoulder 210 extends between first outside diameter 204 and second outside diameter 208 on pump rotor 184.

Pump rotor 184 extends downwardly into a pump case 212 which is attached to lower bearing housing 166 at threaded connection 214. A sealing means, such as a plurality of O-rings 216, provides sealing engagement between pump case 212 and lower bearing housing 166. Pump case 212 defines an elongated bore 218 therethrough which is spaced radially outwardly from second outside diameter 208 of pump rotor 184 such that a pump inlet annulus 220 is defined therebetween. A transverse inlet port 222 is defined in lower bearing housing 166 below shoulder 210 on pump rotor 184. Referring also to FIG. IA, it will be seen that port 222 provides fluid communication between inlet annulus 220 and a well annulus 224 defined between pump 10 and well bore 14.

Figure 2D:
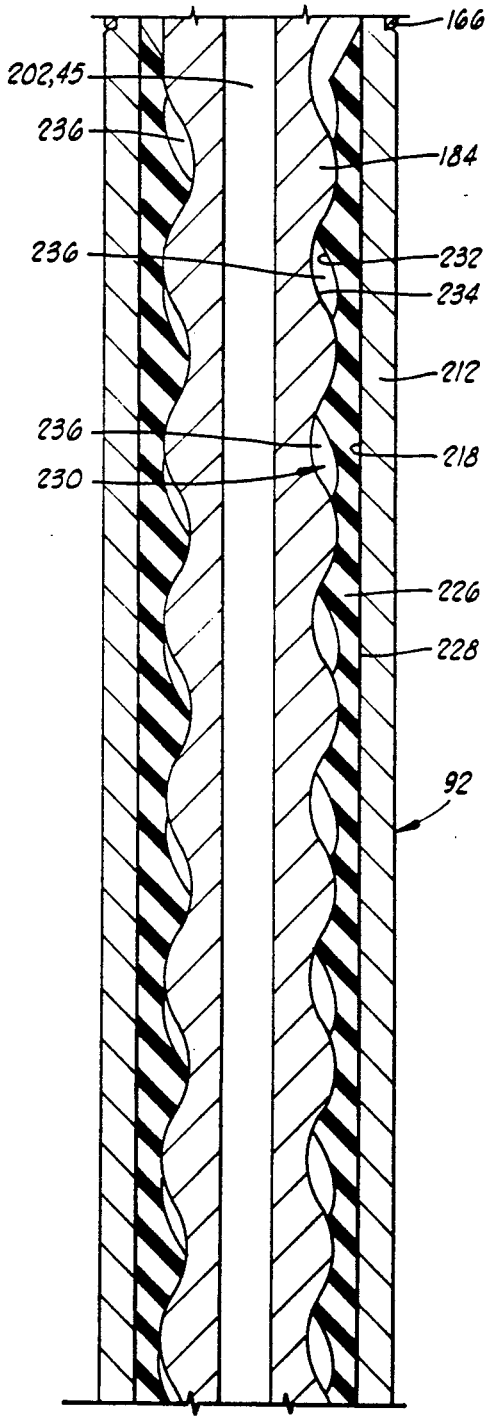

Referring now to FIG. 2D, a pump stator 226 is disposed in pump case 212 and has a substantially cylindrical outer surface 228 adjacent to, and preferably in sealing contact with, bore 218 in the pump case. Pump stator 226 is made of an elastomeric material.

Pump rotor 184 extends through pump stator 226 and is substantially coaxial with the stator and pump case 212.

Pump stator 226 defines an axially extending pumping chamber 230 therethrough. It will be seen that pumping chamber 230 is in fluid communication at one end with inlet annulus 220. The surface defining pumping chamber 230 preferably is corrugated such that a plurality of helical screw-like threads 232 are defined therealong.

A portion of pump rotor 184 below second outside diameter 208 thereof, and which extends through pump stator 226, defines a rounded, substantially helical screw-type threaded surface 234. The interaction of threaded surface 234 with threads 232 in pumping chamber 230 form a plurality of cavities 236 spaced along the length of the pumping chamber.

Figure 2E:
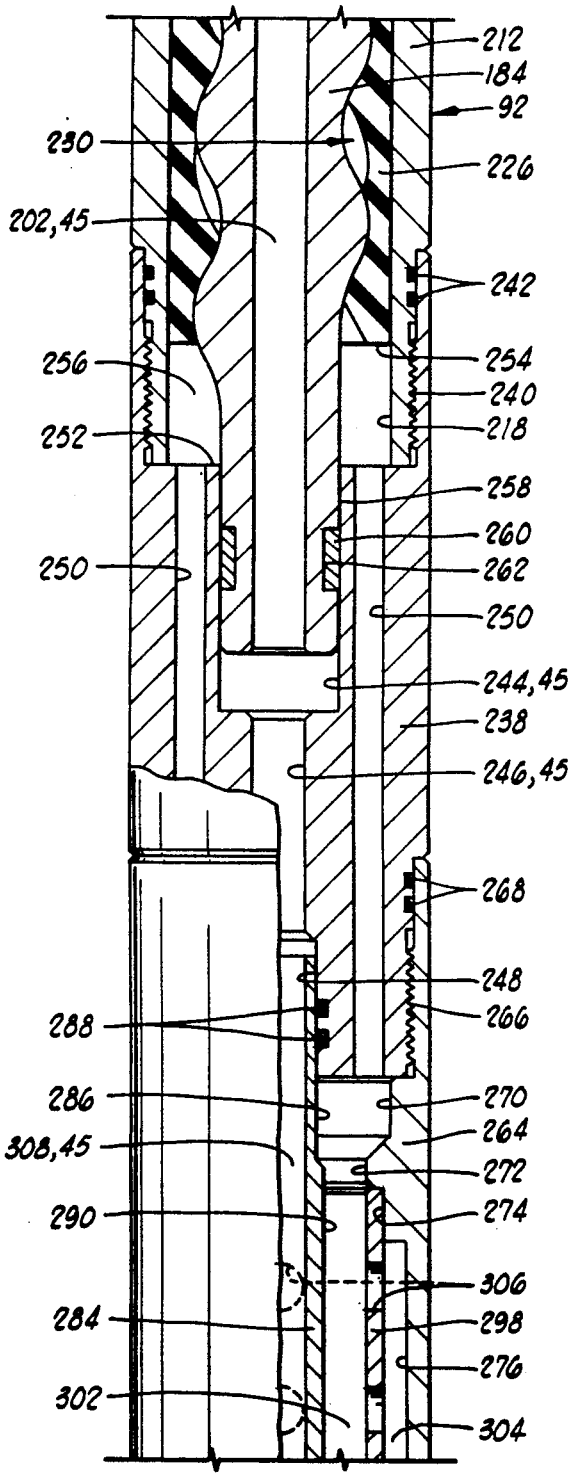

Referring now to FIG. 2E, the lower end of pump case 212 is attached to a rotor support case 238 at threaded connection 240. A sealing means, such as a plurality of O-rings 242, provides sealing engagement between pump case 212 and rotor support case 238.

Rotor support case 238 defines a central opening therethrough formed by first bore 244, second bore 246 and third bore 248. It will be seen that second bore 246 is smaller than both first bore 244 and third bore 248. Spaced radially outwardly from bores 244, 246 and 248, a plurality of longitudinal passageways 250 are defined through rotor support case 238. At the upper end of passageways 250, rotor support case 238 defines an annular shoulder 252.

The lower end of pump stator 226 is spaced above shoulder 252 in rotor support case 238 such that an outlet annulus 256 is defined between pump rotor 184 and bore 218 in pump case 212. It will be seen that outlet annulus 256 is in communication with passageways 250.

The lower end of pump rotor 212 has a substantially cylindrical outer surface 258 which extends into first bore 244 in rotor support case 238. Outer surface 258 is in close, rotating relationship to bore 244. An annular bushing 260 is positioned in a groove 262 in the lower end of pump rotor 184, and the bushing is rotatable with end bore 244. It will be seen by those skilled in the art that bushing 260 characterizes a rotor bearing means for providing radial support and alignment for pump rotor 184. Since pump rotor 184 is attached to upper mandrel means 72, it may be said that the bearing mandrel means characterized by upper bearing 146 and lower bearing 174 comprises a portion of the rotor bearing means as well.

Second bore 246 and the portion of first bore 244 below pump rotor 184 form parts of passageway means 45.

The lower end of rotor support case 238 is connected to a tube case 264 at threaded connection 266. A sealing means, such as a plurality of O-rings 268, provides sealing engagement between rotor support case 238 and tube case 264.

Figure 2F:
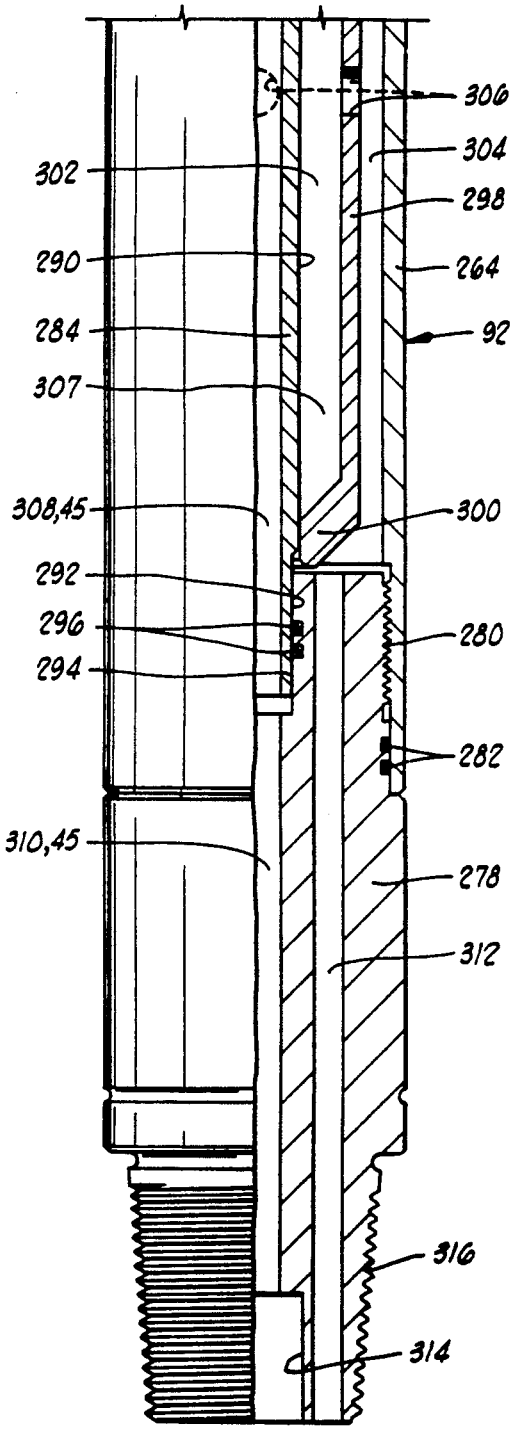

Tube case 264 has first, second, third and fourth bores 270, 272, 274 and 276 therethrough, respectively. Referring now also to FIG. 2F, the lower end of tube case 264 is attached to a lower adapter 278 at threaded connection 280. A sealing means, such as a plurality of O-rings 282, provides sealing engagement therebetween.

Still referring to FIGS. 2E and 2F, a flow tube 284 is disposed in tube case 264. Flow tube 284 has an upper end having a first diameter 286 which extends into, and fits closely within, third bore 248 of rotor support case 238. A sealing means, such as a plurality of O-rings 288, provides sealing engagement therebetween. Below first diameter 286, flow tube 284 has an intermediate portion having a second outside diameter 290. The lower end of flow tube 284 has a third outside diameter 292 which extends into and fits closely within first bore 294 of lower adapter 278. A sealing means, such as a plurality of O-rings 296, provides sealing engagement between flow tube 284 and lower adapter 278.

Disposed annularly around flow tube 284 within tube case 264 is a ported mandrel 298. Ported mandrel 298 has an upper end which fits closely within third bore 274 in tube case 264 and an enlarged, inwardly directed lower end 300 which fits closely around second outside diameter 290 of flow tube 284 adjacent to lower adapter 278. It will be seen that an inner annulus 302 is defined between flow tube 284 and ported mandrel 298, and an outer annulus 304 is defined between ported mandrel 298 and fourth bore 276 in tube case 264. Inner annulus 302 is in communication with passageways 250 in rotor support case 238.

Inner annulus 302 and outer annulus 304 are in communication with each other through transverse ports 306 in the upper end of ported mandrel 298. The portion of ported mandrel 298 below ports 306 and the lower end of flow tube 284 define a lower end 307 of inner annulus 302, also referred to as lower annulus portion 307. Fluid entering inner annulus 302 from passageways 250 is reduced in velocity because the cross-sectional area of inner annulus 302 is relatively larger than the collective cross-sectional areas of passageways 250. Becuase of this velocity reduction, at least a portion of any solid materials or debris which may be pumped into inner annulus 302 has a tendency to fall out and collect in lower annulus portion 307 rather than being pumped out through ports 306 and to the inflatable packers. Thus, a debris collection means is provided for collecting fluid debris in pump 10 and preventing transfer of at least some of the fluid debris to the packers.

Flow tube 284 has a central opening 308 therethrough which is in communication with second bore 246 in rotor support case 238 and thus forms part of passageway means 45. Lower adapter 278 has a central opening 310 therethrough which is in communication with central opening 308 in flow tube 284 and also is a portion of passageway means 45.

Spaced radially outwardly from central opening 310 lower adapter 278 defines a plurality of longitudinally extending passageways 312 therethrough. It will be seen by those skilled in the art that passageways 312 are in communication with outer annulus 304.

The lower end of lower adapter 278 defines a bore 314 which is part of central opening 310. The lower end of lower adapter 278 also has an externally threaded portion 316. Threaded portion 316 and bore 314 are adapted for engagement with a portion of testing apparatus 12 positioned below pump 10, in a manner known in the art. The lower portion of testing apparatus 12 has a passageway therethrough (not shown) in fluid communication with upper packer 32 and lower packer 34. This passageway is in fluid communication with passageways 312 in lower adapter 278 in pump 10.

OPERATION OF THE INVENTION

Oil reservoir 192 is precharged with lubricating oil through hole 194 as already described. As testing apparatus 12 is lowered into well bore 14, equalizing piston 116 is preferably at the uppermost position in equalizing chamber 112. That is, equalizing piston 116 is adjacent to the lower end of piston cap 96.

Testing apparatus 12 is lowered until upper packer 32 and lower packer 34 are properly positioned on opposite sides of formation 16. In this position, upper adapter means 42 is spaced above case means 92 as illustrated in FIGS. 2A and 2B. In other words, spline 76 of torque body 74 is in contact with upper end 56 of torque case 52.

Drag springs 40 at the lower end of testing apparatus 12 help center the apparatus and prevent relative rotation of the lower portion of testing apparatus 12. Because case means 92 is attached to the lower portion of testing apparatus 12 by lower adapter 278, the case means is also prevented from rotation by drag strings 40. Thus, it will be seen that by rotation of tool string 18, the upper portion of testing apparatus 12 including upper adapter means 42 and upper mandrel means 72 will be rotated with respect to case means 92 of pump 10.

As upper mandrel means 72 is rotated, pump rotor 184 is rotated with respect to pump stator 226 because the pump rotor is attached to the upper mandrel means. Pump rotor 184 is thus rotated about the pump axis within pumping chamber 236. Because of threaded surface 234 of pump rotor 184, fluid entering inlet annulus 220 through inlet ports 222 from well annulus 224 is forced into the cavity 236 nearest inlet annulus 220. In a manner generally known in the art, the fluid is progressively moved from cavity to cavity and discharged into outlet annulus 256, hence the term "progressive cavity" pump. Pump stator 226 preferably has sufficient frictional contact with pump case 212 and also has sufficient strength to remain in the position shown in the pumping operation.

This continuous pumping action of pump rotor 184 within pump stator 226 causes pumping of fluid from well annulus 224 into outlet annulus 256 in pump 10 and from there downwardly through passageways 250 in rotor support case 238, inner annulus 302 and outer annulus 304 in tube case 64, and passageways 312 in lower adapter 278. The fluid is further pumped from there downwardly through the lower portion of testing apparatus 12 to inflate upper packer 32 and lower packer 34 into sealing engagement with well bore 14 adjacent to well formation 16. The actual inflation of upper packer 32 and lower packer 34 is known in the art.

Once upper packer 32 and lower packer 34 are properly inflated, testing of fluids in well formation 16 may be carried out in a manner known in the art. Such fluids are carried upwardly through testing apparatus 12 including through passageway means 45 of pump 10.

As already indicated, equalizing piston 116 is preferably at the uppermost point in equalizing chamber 112 as testing apparatus 12 is lowered into well bore 14. The increased fluid pressure in well bore 14 causes a compression of the lubricating oil in oil reservoir 192, including the portion thereof defined by equalizing chamber 112. As this occurs, equalizing piston 116 will move downwardly in equalizing chamber 112. Well annulus fluid will enter the equalizing chamber above piston 116 through opening 114 in floating piston case 98. Thus, the hydrostatic pressure in oil reservoir 192 is equalized with the pressure in well annulus 224.

As testing string 12 is raised to test a shallower formation 16 or is removed from well bore 14, the hydrostatic fluid pressure is again equalized on both sides of piston which eliminates the possibility of rupture of any seals.

During pumping operation, it is desirable to limit the pressure output by pump 10 so that overinflation of upper packer 32 and lower packer 34 is prevented. In the prior art, such pressure limitation has been typically provided by relief valves which bypass fluid directly from the pumping chamber to the well annulus or by pressure limiters which bypass fluid to another portion of testing string 12 and do not vent to the well annulus. Such relief valves and pressure limiters are mechanical devices which add to the complexity and expense of the pump. In the present invention, progressive cavity pump 10 itself will only supply a predetermined pressure and thus acts as its own pressure limiter due to preselected sizing of pump rotor 184 and pump stator 226. That is, when the differential pressure reaches the predetermined maximum level, fluid slippage between pump rotor 184 and pump stator 226 is sufficient to prevent the discharge pressure from further increasing. This eliminates one component, namely the relief valve or pressure limiter, which allows a more compact and less expensive tool string 12 and provides simpler operation.

Once testing of fluids in well formation 16 is completed, upper packer 32 and lower packer 34 are deflated by actuating packer bypass 226. Such a packer bypass 226 is described in U.S. Pat. No. 4,756,364, assigned to the assignee of the present invention, a copy of which is incorporated herein by reference. Other methods of deflating packers 32 and 34 known in the art may also be used, and pump 10 is not limited to any particular deflating method.

When it is desired to have rotation below pump 10, such a to operate safety joint 30 in a situation where the tool is stuck, tool string 18 may be lowered until lugs 58 on torque case 52 of upper adapter means 42 engage lugs 108 on piston cap 96 of case means 92. When lugs 58 and 108 are so engaged, rotation of tool string 18 and adapter means 42 overcomes the friction of drag springs 40 and results in rotation of case means 92 and the portion of testing string 12 below pump 10 and above safety joint 30. The torque applied by rotation in such a manner is generally sufficient to index safety joint 30 in a manner known in the art.

It will be seen, therefore, that the progressive cavity pump apparatus of the present invention is well adapted to carry out the ends and advantages mentioned, as well as those inherent therein. While a presently preferred embodiment of the apparatus has been described for the purposes of this disclosure, numerous changes in the arrangement and construction of parts may be made by those skilled in the art. All such changes are encompassed within the scope and spirit of the appended claims.

What is claimed is:

1. A downhole inflatable packer pump comprising:

case means for attaching to a lower testing string portion and having an inlet and an outlet, said outlet being communicable with an inflatable packer at a location below said pump;

mandrel means, rotatably disposed within said case means, for connecting to an upper testing string portion for mutual rotation therewith and rotating within said case means;

an elastomeric pump stator disposed in said case means, said stator having a convoluted inner surface;

a rotor extending form said mandrel means and into said stator, said rotor having a convoluted outer surface, said stator and rotor defining a plurality of cavities therebetween, whereby rotation of said rotor within said stator moves fluid progressively from cavity to cavity and thereby from said inlet to said outlet;

passageway means for providing fluid communication between said lower testing string portion and said upper testing string portion, said passageway means being sealingly separated from said cavities.

2. The pump of claim 1 further comprising bearing means for rotatably supporting said mandrel means in said case means.

3. The pump of claim 2 further comprising oil reservoir means for providing lubrication to said bearing means.

4. The pump of claim 1 further comprising debris collection means for collecting at least a portion of fluid debris within said pump and preventing discharge of said portion of said debris therefrom.

5. The pump of claim 1 further comprising bearing means for supporting an end of said rotor opposite said mandrel means.

6. The pump of claim 1 wherein said stator sealingly engages an inner surface of said case means.

7. The pump of claim 1 further comprising means for selectively preventing relative rotation between said case means and said mandrel means such that rotation of said upper testing string portion results in rotation of said lower testing string portion.

8. The pump of claim 1 wherein said passageway means is characterized at least in part by a central opening defined in said rotor.

9. The pump of claim 1 wherein said rotor and stator are sized such that differential pressure across the pump is substantially limited to a predetermined value.

10. A pump for use with an inflatable well packer, said pump comprising:

a case defining an inlet port and an outlet passageway therein, said outlet passageway being communicable with the inflatable packer at a location below said pump in the well bore;

a stator disposed in said case between said inlet port and said outlet passageway, said stator having a convoluted inner surface;

a rotor disposed in said stator and rotatable with respect to said stator and said case, said rotor defining a screw-type threaded outer surface thereon engaged with said convoluted inner surface of said stator such that a plurality of progressive pumping cavities are defined therebetween, and said rotor further defining a central opening therethrough whereby fluid may flow through said pump from a location below said pump in said well bore; and wherein said central opening in said rotor is sealingly separated from said cavities between said rotor and said stator.

11. The pump of claim 10 further comprising bearing means for rotatably supporting said rotor in said case.

12. The pump of claim 11 wherein said bearing means comprises a bushing disposed on a lower end of said rotor.

13. The pump of claim 10 wherein:

said rotor and said case define an annular inlet chamber above said stator and adjacent to said inlet port; and said rotor and said case define an annular outlet chamber therebetween and below said stator.

14. A pump for use with an inflatable well packer, said pump comprising:

a case defining an inlet port and an outlet passageway therein, said outlet passageway being communicable with the inflatable packer at a location below said pump in the well bore;

a stator disposed in said case between said inlet port and said outlet passageway, said stator having a convoluted inner surface;

a rotor disposed in said stator and rotatable with respect to said stator and said case, said rotor defining a screw-type threaded outer surface thereon engaged with said convoluted inner surface of said stator such that a plurality of progressive pumping cavities are defined therebetween, and said rotor further defining a central opening therethrough whereby fluid may flow through said pump from a location below said pump in said well bore; and wherein said case defines a debris collection chamber below said rotor and said stator whereby at least some debris discharged from said pumping cavities is collected and prevented from being discharged from said outlet passageway.

* * * * *